US010888494B2

(12) United States Patent
Zhijian

(10) Patent No.: US 10,888,494 B2
(45) Date of Patent: Jan. 12, 2021

(54) MASSAGE HOLDER APPARATUS

(71) Applicant: Li Zhijian, Fuzhou (CN)

(72) Inventor: Li Zhijian, Fuzhou (CN)

( * ) Notice: Subject to any disclaimer, the term of this patent is extended or adjusted under 35 U.S.C. 154(b) by 0 days.

(21) Appl. No.: 16/693,452

(22) Filed: Nov. 25, 2019

(65) Prior Publication Data

US 2020/0222278 A1 Jul. 16, 2020

Related U.S. Application Data

(63) Continuation-in-part of application No. 16/693,259, filed on Nov. 23, 2019.

(30) Foreign Application Priority Data

Jan. 11, 2019 (CN) ..... 2019 1 0028229

(51) Int. Cl.

| | |
|---|---|
| ***A45F 3/04*** | (2006.01) |
| ***A61H 37/00*** | (2006.01) |
| ***A45C 15/00*** | (2006.01) |
| ***A41D 1/04*** | (2006.01) |
| ***A45F 3/02*** | (2006.01) |
| *A45F 3/00* | (2006.01) |

(52) U.S. Cl.

CPC ..... *A61H 37/00* (2013.01); *A41D 1/04* (2013.01); *A45C 15/00* (2013.01); *A45F 3/02* (2013.01); *A45F 3/04* (2013.01); *A41D 2400/322* (2013.01); *A45F 2003/003* (2013.01); *A61H 2201/0157* (2013.01); *A61H 2201/165* (2013.01); *A61H 2201/50* (2013.01)

(58) Field of Classification Search

CPC ... A45C 15/00; A45F 3/04; A45F 3/02; A45F 3/12; A41C 3/00

See application file for complete search history.

(56) References Cited

U.S. PATENT DOCUMENTS

| | | | | |
|---|---|---|---|---|
| 3,957,184 | A * | 5/1976 | Shurman | A45F 3/04 224/630 |
| 6,816,760 | B1 | 11/2004 | Namaky | |
| 6,870,089 | B1 | 3/2005 | Gray | |
| 9,144,255 | B1 * | 9/2015 | Perciballi | A41D 27/00 |
| 10,561,225 | B2 | 2/2020 | Parekh | |
| 10,616,534 | B2 * | 4/2020 | Thiel | F41H 1/02 |
| 2002/0198031 | A1 | 12/2002 | Holmes | |
| 2003/0062391 | A1 * | 4/2003 | Mitchell | A45F 3/04 224/576 |
| 2003/0168488 | A1 * | 9/2003 | Ho | A45F 3/04 224/629 |
| 2005/0020184 | A1 * | 1/2005 | Izcoa | A41C 3/12 450/86 |
| 2005/0140331 | A1 | 6/2005 | McQuade | |

(Continued)

FOREIGN PATENT DOCUMENTS

KR 2014132850 A 11/2014

*Primary Examiner* — Brian D Nash

(74) *Attorney, Agent, or Firm* — Jennifer Meredith, Esq.; Meredith Attorneys, PLLC

(57) ABSTRACT

A massage apparatus holder, comprising: a first holder side having a first substantially flat portion and an indentation shaped to receive a portion of a massage apparatus; a second holder side having a second substantially flat portion, wherein the holder is larger in size than the massage apparatus, the thickness is at least 7 mm and a portion of the holder is attached to a body.

20 Claims, 19 Drawing Sheets

(56) References Cited

U.S. PATENT DOCUMENTS

2006/0113343 A1* 6/2006 Chang ..... A61H 23/02 224/576
2007/0297149 A1 12/2007 Richardson
2008/0011799 A1 1/2008 Chang
2008/0125164 A1 5/2008 Singh
2008/0210728 A1 9/2008 Bihn
2009/0061926 A1 3/2009 Lee
2009/0201671 A1* 8/2009 Huntley ..... A45C 15/06 362/108
2009/0224722 A1 9/2009 Causey
2009/0276089 A1 11/2009 Bartholomew
2011/0110514 A1 5/2011 Gustavsson
2012/0262117 A1 10/2012 Ferber
2012/0299528 A1 11/2012 Scarmozzino
2013/0026726 A1 1/2013 Thomas
2013/0162389 A1 6/2013 Crucs
2013/0214931 A1 8/2013 Chia
2013/0249673 A1 9/2013 Ferrari
2014/0002239 A1 1/2014 Rayner
2014/0061273 A1 3/2014 Bullivant
2014/0171132 A1 6/2014 Ziemianska
2015/0296644 A1 10/2015 Chin
2015/0326044 A1 11/2015 Ashley
2015/0359127 A1 12/2015 Daoura
2015/0366333 A1* 12/2015 Zhijian ..... A45F 4/02 224/576
2016/0112004 A1* 4/2016 Thiel ..... H02S 30/20 136/246
2016/0118634 A1* 4/2016 Thiel ..... A41D 13/015 429/99
2016/0141904 A1* 5/2016 Zhijian ..... H02J 7/342 320/103
2017/0027806 A1* 2/2017 Lin ..... A45F 4/02
2017/0196347 A1* 7/2017 Sawhney ..... A63B 55/408
2019/0343266 A1* 11/2019 Parekh ..... A61H 7/00
2019/0374012 A1* 12/2019 Chang ..... A45F 3/04

* cited by examiner

MASSAGE HOLDER APPARATUS

CROSS-REFERENCE TO RELATED APPLICATIONS

This application is a continuation-in-part of application Ser. No. 16/693,259 filed Nov. 23, 2019, which in turn claims priority to Chinese application number 201910028229.9. filed Jan. 11, 2019, both of which are incorporated herein by reference.

BACKGROUND

The present invention is related to a holder for a massage apparatus. The prior art teaches various inventions directed to massage apparatus, but the present invention provides a holder for a massage apparatus which may be attached to a "body." The holder reduces the intensity of a massage apparatus which is retained therein, reduces resonance and noise. The "body" of the invention may be, for example, a shoulder strap on a backpack, shoulder bag, travel bag, messenger bag, baby carrier or in a vest. There may be an additional cover surrounding the massage apparatus which further reduces the resonance, and noise. There may also be an adhesive layer which secures and retains the cover and massage apparatus inside the holder and further helps to reduce the resonance and noise.

SUMMARY

According to one aspect of the present invention, a massage apparatus holder is provided, comprising: a first holder side having a first substantially flat portion and an indentation shaped to receive a portion of a massage apparatus; a second holder side having a second substantially flat portion, wherein the holder is larger in size than the massage apparatus, the thickness is at least 7 mm and a portion of the holder is attached to a body.

BRIEF DESCRIPTION OF THE DRAWINGS

In the following section, the present disclosure will be described with reference to exemplary embodiments illustrated in the figures, in which.

DETAILED DESCRIPTION

In the following detailed description, numerous specific details are set forth in order to provide a thorough understanding of the disclosure. However, it will be understood by those skilled in the art that the present disclosure may be practiced without these specific details. In other instances, well-known methods, procedures, components and circuits have not been described in detail so as not to obscure the present disclosure.

Reference throughout this specification to "one embodiment" or "an embodiment" means that a particular feature, structure, or characteristic described in connection with the embodiment is included in at least one embodiment of the present disclosure. Thus, the appearances of the phrases "in one embodiment" or "in an embodiment" or "according to one embodiment" (or other phrases having similar import) in various places throughout this specification are not necessarily all referring to the same embodiment. Furthermore, the particular features, structures, or characteristics may be combined in any suitable manner in one or more embodiments. Also, depending on the context of discussion herein, a singular term may include its plural forms and a plural term may include its singular form. Similarly, a hyphenated term may be occasionally interchangeably used with its non-hyphenated version, and a capitalized entry may be interchangeably used with its non-capitalized version. Such occasional interchangeable uses shall not be considered inconsistent with each other.

Figure 1:
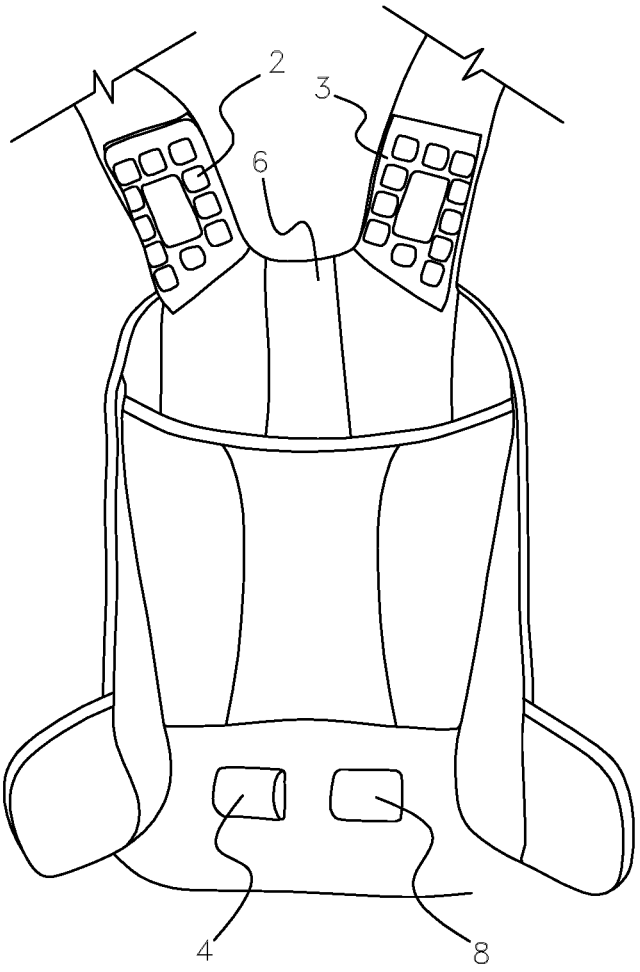
FIG. 1 is a backpack embodiment according to the present invention.
Figure 2:
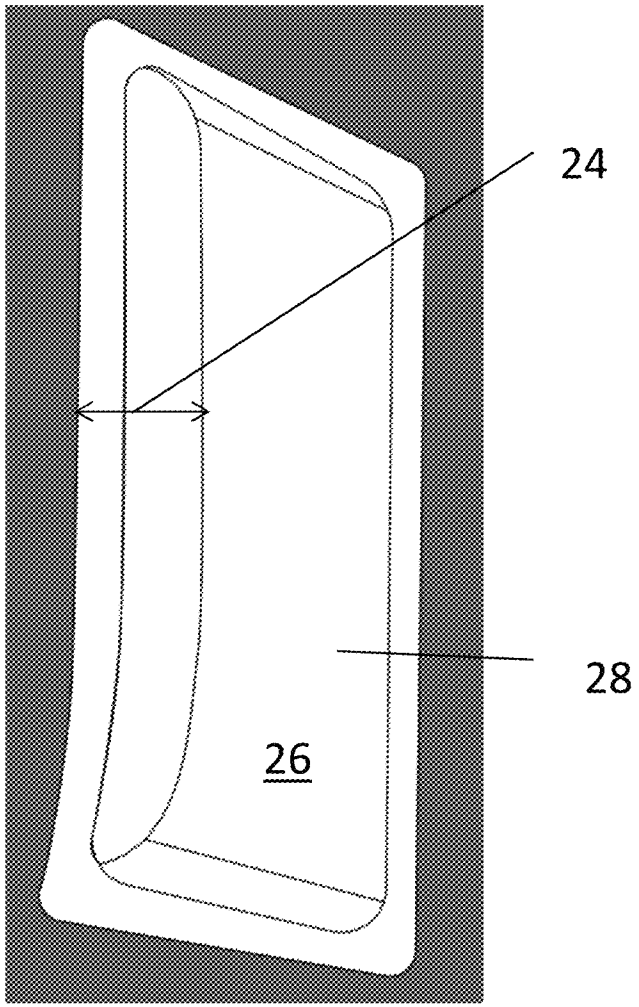
FIG. 2 depicts a holder according to the present invention.
Figure 5:
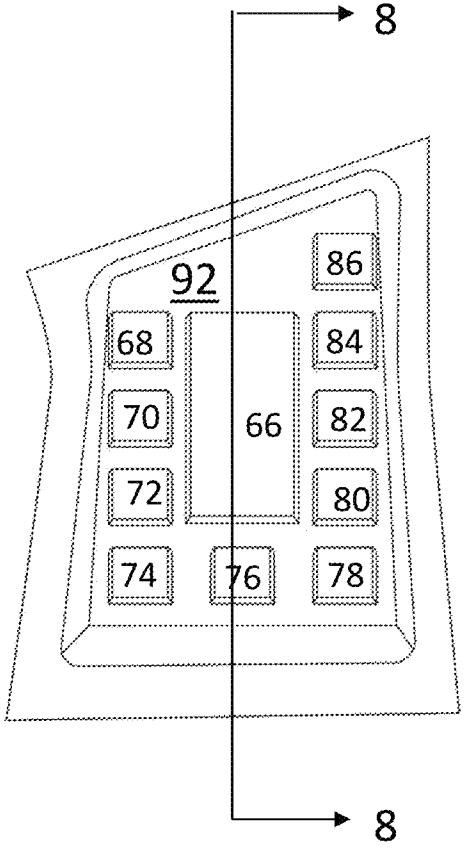
FIG. 5 depicts a holder with a center raised portion and surrounding raised portions which surround the center raised portion.
Figure 10:
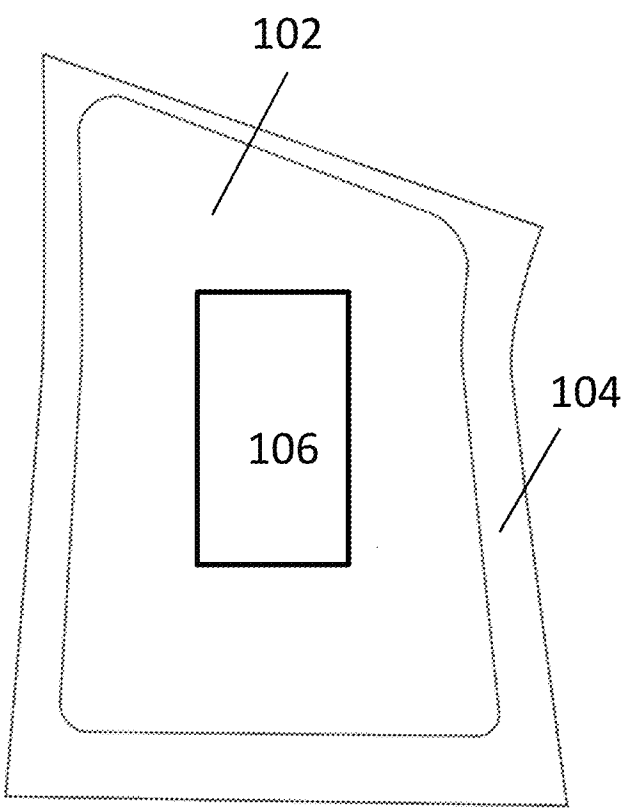
FIG. 10 depicts a back view of the holder depicted in FIG. 9.
Figure 9:
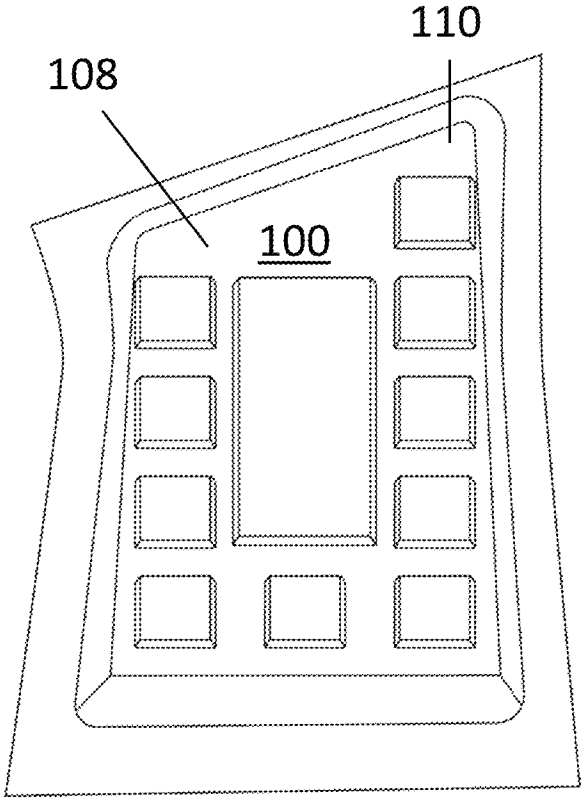
FIG. 9 depicts a front view of a holder with a center raised portion and surrounding raised portions which surround the center raised portion.
Figures 16, 17, 18:
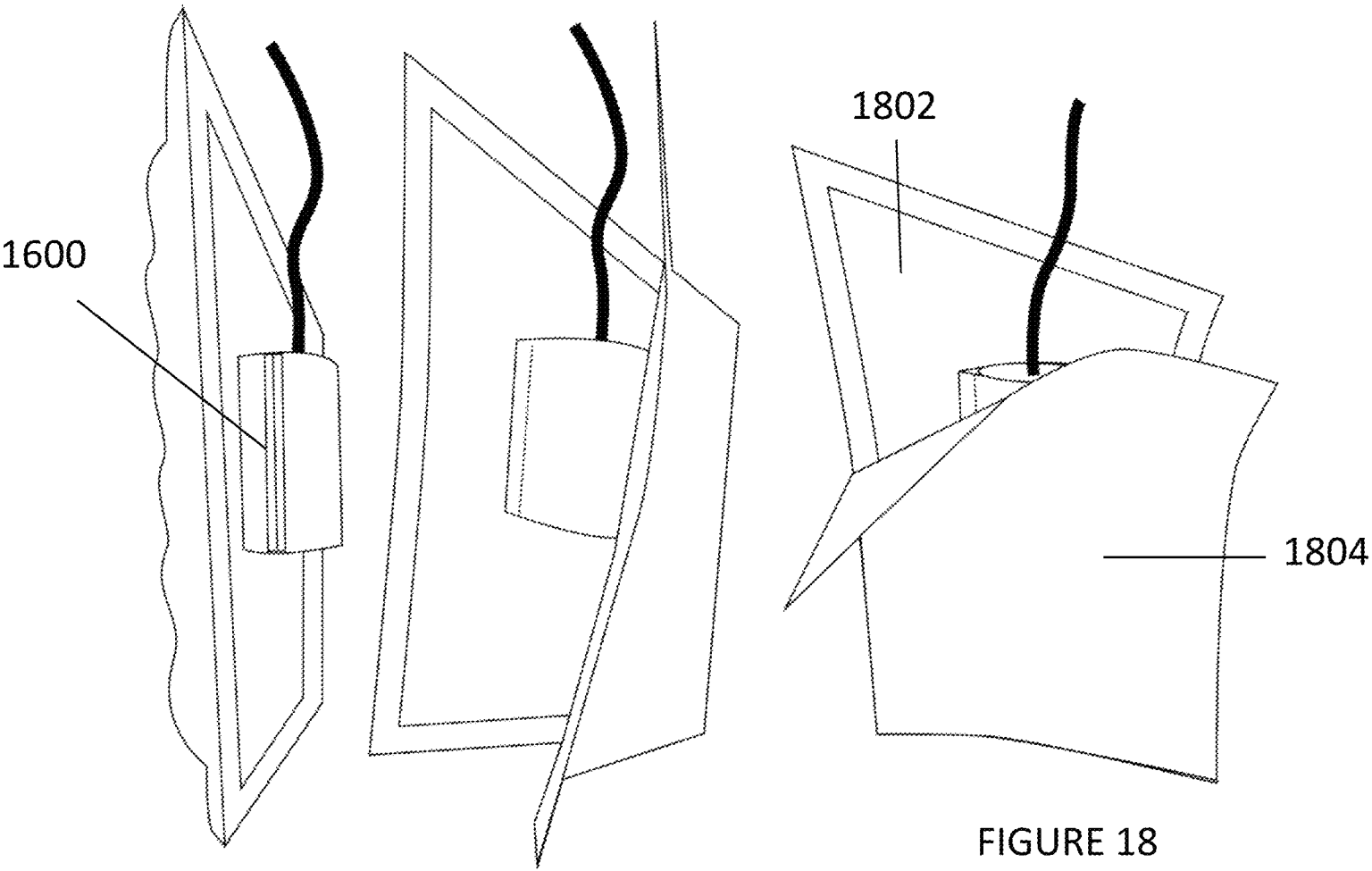
FIG. 16 depicts a side view of the holder with a massage apparatus therein.
FIG. 17 depicts a side view of the holder with a massage apparatus therein.
FIG. 18 depicts a bottom view of the holder with a massage apparatus therein and at least one layer of material which retains, protects and covers the massage apparatus.
Figure 20:
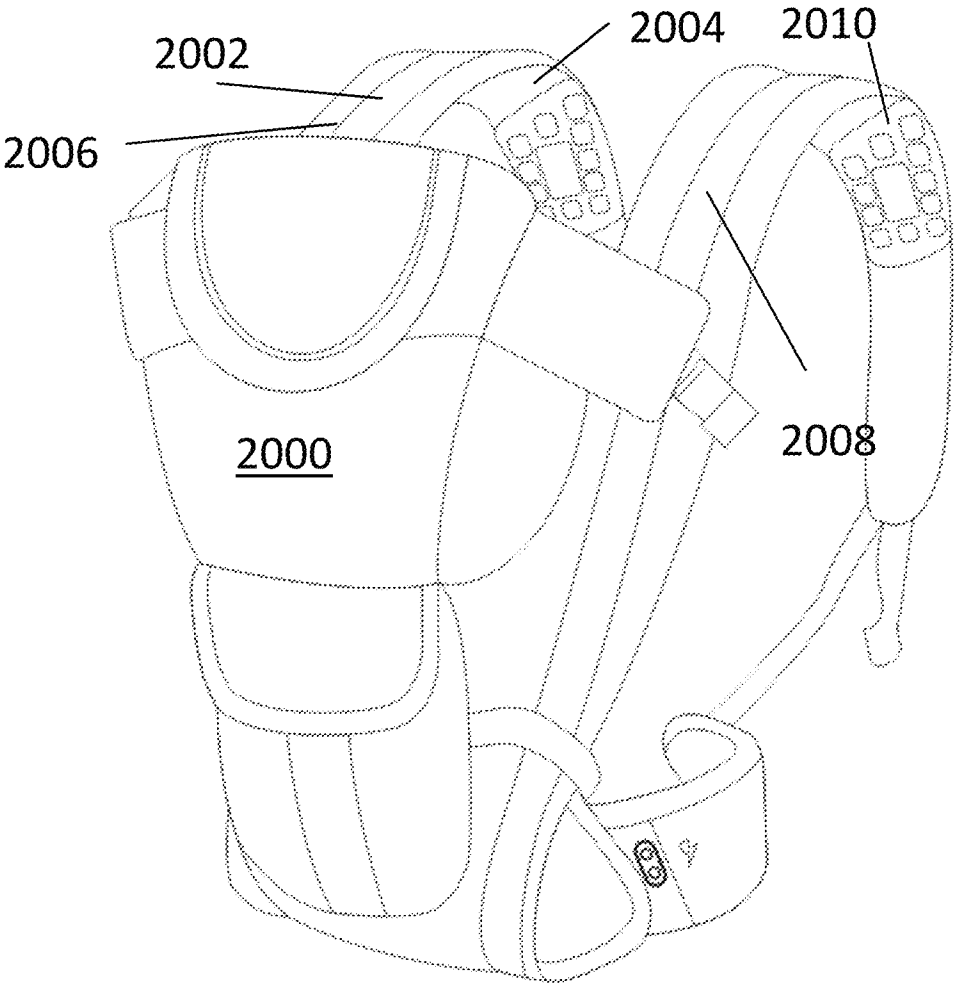
FIG. 20 depicts a holder attached to the shoulder straps of a baby carrier.
Figure 19:
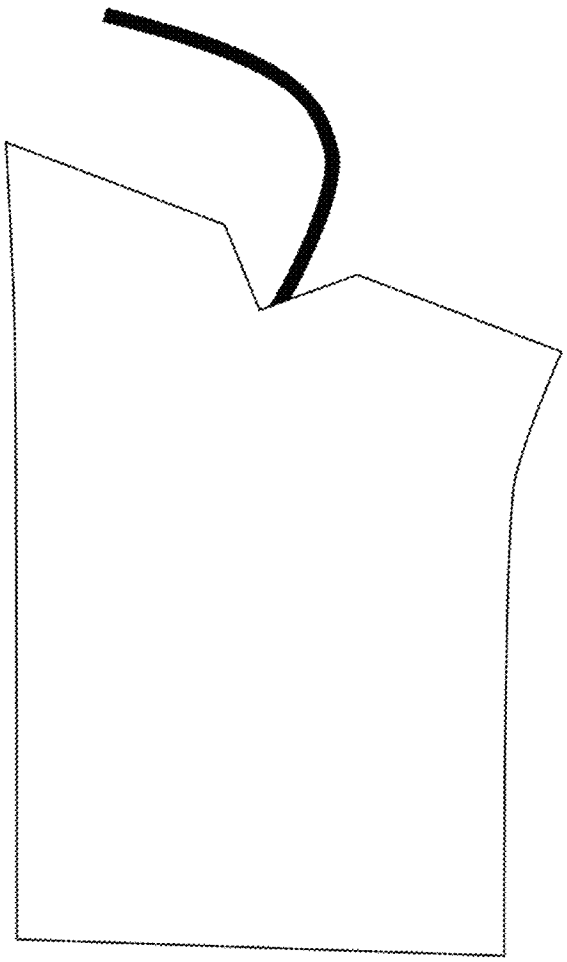
FIG. 19 depicts a bottom view of the holder with a massage apparatus therein and at least one layer of material which retains, protects and covers the massage apparatus.
Figure 22:
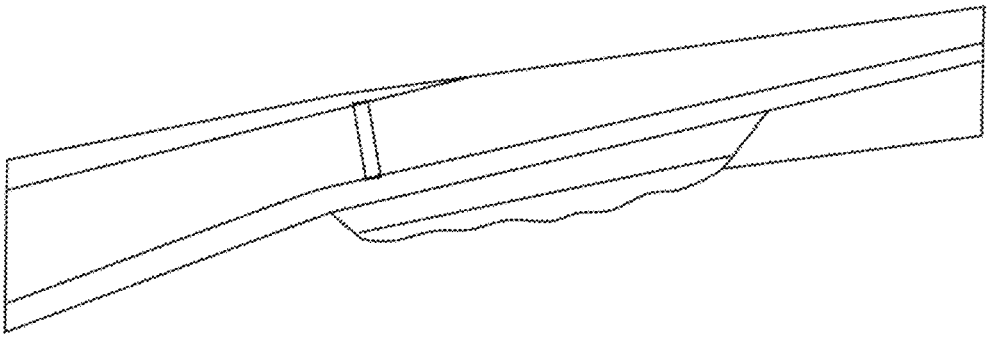
FIG. 22 depicts a shoulder strap of a body.
Figure 21:
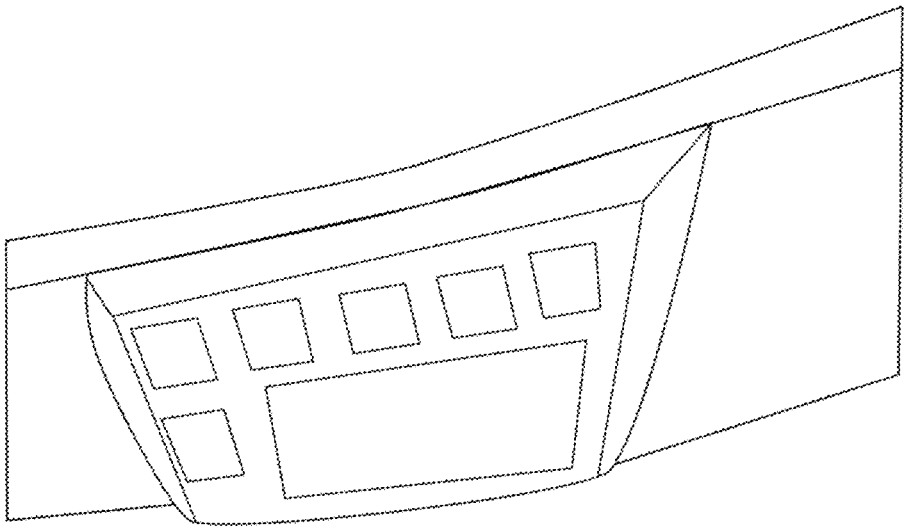
FIG. 21 depicts a holder with a raised portion and surrounding raised portions.
Figure 23:
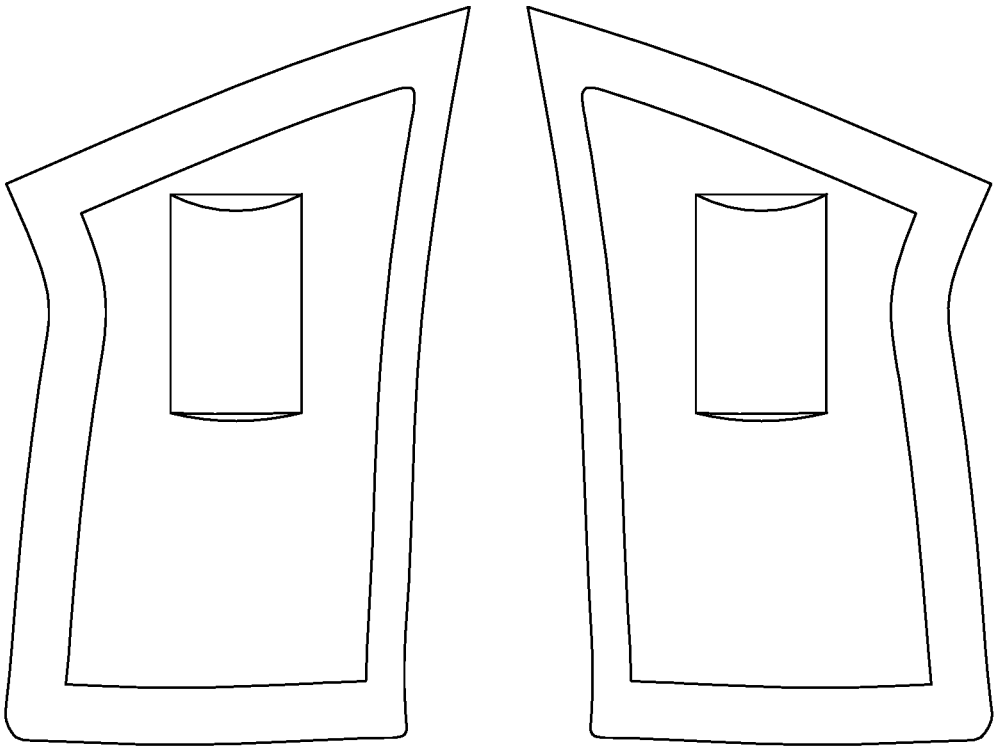
FIG. 23 depicts the bottom view of two holders as would be utilized for a backpack or baby carrier.
Figure 24:
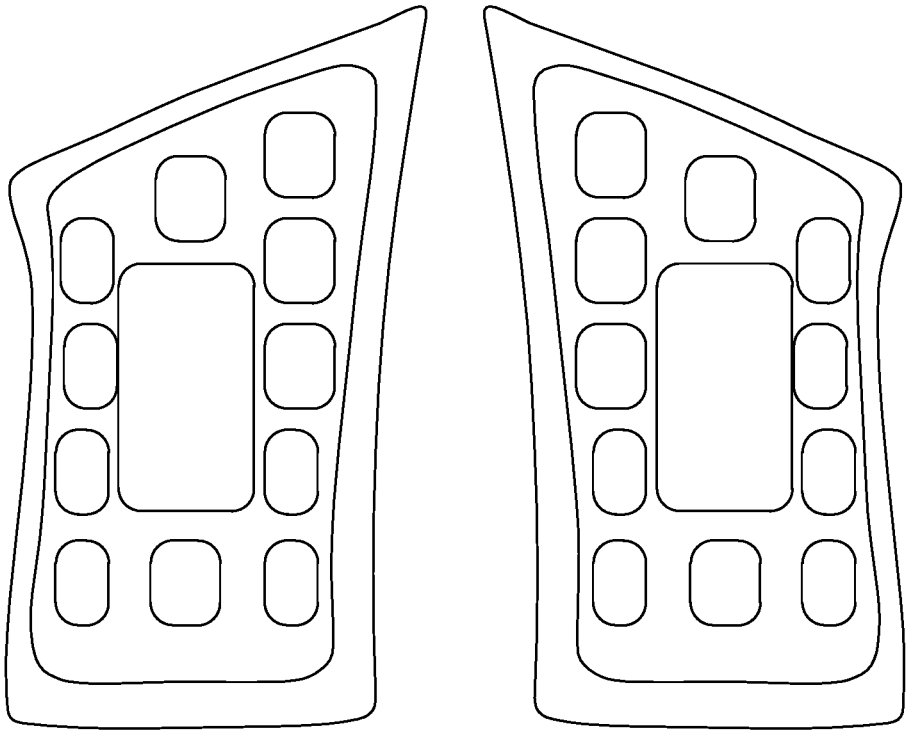
FIG. 24 depicts the top view of the two holders as depicted in FIG. 23.

As shown in FIG. 1, a body (6) having a back portion (4), wherein the second holder side (8) is substantially linear with the back portion (4). FIG. 1 also depicts the massage apparatus holders (2, 3) in the backpack straps. FIGS. 9 and 10 depict a massage apparatus holder (100), comprising: a first holder side (102) having a first substantially flat portion (104) and an indentation (106) shaped to receive a portion of a massage apparatus (see FIG. 16, massage apparatus 1600); a second holder side (108) having a second substantially flat portion (110), wherein the holder (100) is larger in size than the massage apparatus, the thickness is at least 7 mm and a portion of the holder is attached to a body. The holder may be made of a foam material selected from the group consisting of Ethylene-vinyl acetate foam, Poly urethane foam, butadiene rubber foam, vinyl acetate foam. Expandable Polyethylene, Polyethylene, Crosslinked polyethylene foaming, Electron radiation crosslinked polyethylene foaming, or any other foamy material. The thickness (24) is depicted in FIG. 2. The thickness of at least 7 mm has been found to provide the desired reduction in intensity of the massage apparatus and reduction of resonance and noise. As shown in FIG. 20, the body (2000) has at least one shoulder strap (2006 and 2008) with a rear side portion (2004) and an outside portion (2002), wherein the second holder side (2010) of the massage apparatus holder is substantially linear with the rear side portion (2004) of the shoulder strap (2008). The shoulder strap may be on a backpack, shoulder bag, travel bag, messenger bag, baby carrier, vest.

Figure 4:
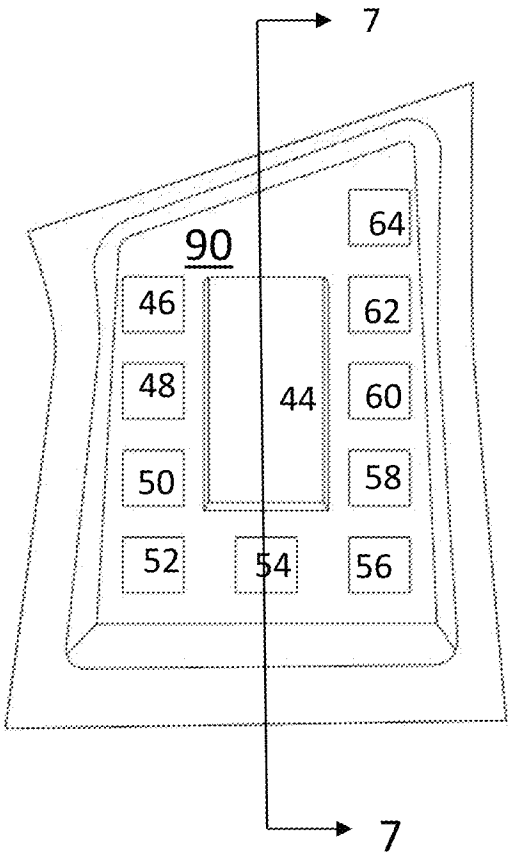
FIG. 4 depicts a holder with a center raised portion and surrounding raised portions which surround the center raised portion.
Figure 3:
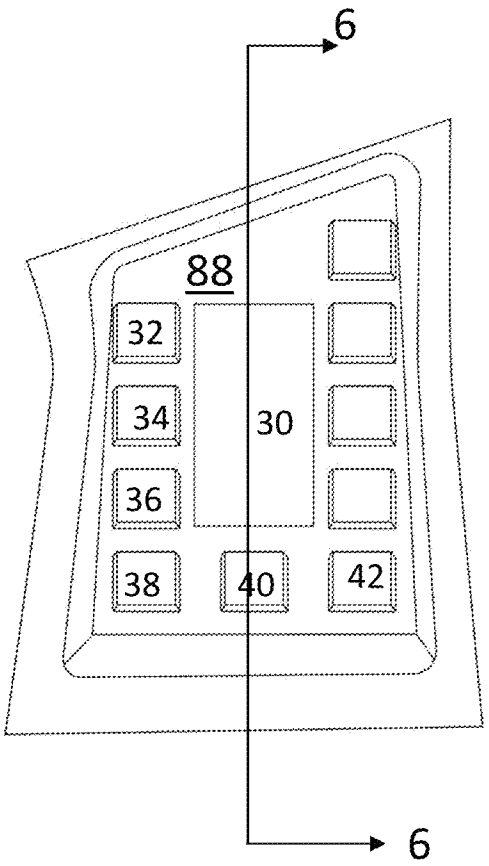
FIG. 3 depicts a holder with a center raised portion and surrounding raised portions which surround the center raised portion.
Figure 7:
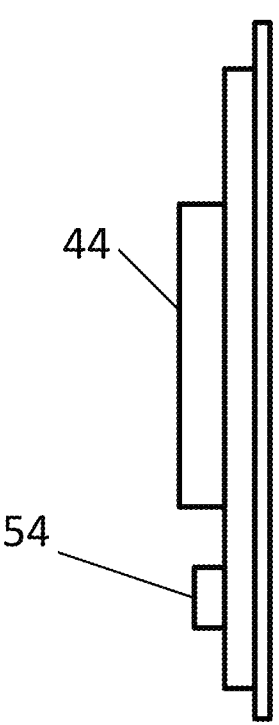
FIG. 7 depicts a cutaway of FIG. 4.
Figure 8:
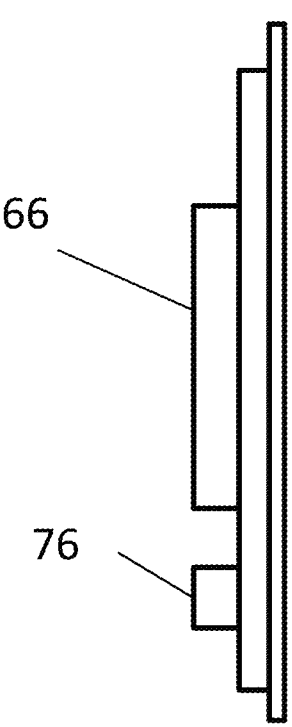
FIG. 8 depicts a cutaway of FIG. 5.
Figure 6:
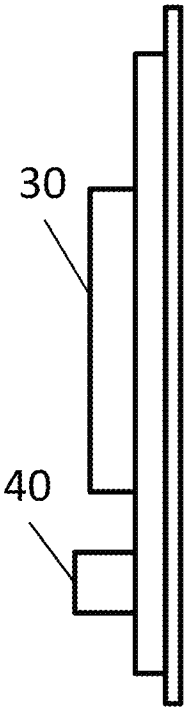
FIG. 6 depicts a cutaway of FIG. 3.

As shown in FIGS. 3, 4, 5, 6, 7, and 8, the second side of the holder (88, 90 and 92) has a center raised portion (e.g. 30, 44 and 66), shaped to correspond the massage apparatus and at least two surrounding raised portions (e.g. 32, 34, 36, 38, 40, 42, 46, 48, 5-, 52, 54, 56, 58, 60, 62, 64, 69, 70, 72, 74, 76, 78, 80, 82, 84, 86) which surround the center raised portion (e.g. 30, 44 and 66). FIG. 6 is a cutaway of FIG. 3, FIG. 7 is a cutaway of FIG. 4 and FIG. 8 is a cutaway of FIG. 5. FIG. 6 depicts the height of the center raised portion is lower than each of the surrounding raised portions. FIG. 7 depicts the height of the center raised portion is higher than each of the surrounding raised portions. FIG. 8 depicts the height of the center raised portion and each of the surrounding raised portions are substantially the same level. According to one embodiment, the height difference of the center raised portion and each of the surrounding raised portions are between 5 mm and 20 mm. This height difference has been found critical to provide the desired reduction in intensity of the massage apparatus and reduction of resonance and noise. The shape of the surrounding raised portions may be selected from the group consisting of rectangular, circular, square and elliptical. It has been found that a substantially square shape pro-vides a desired reduction in intensity of the massage. Between the center raised and the at least two surrounding raised portions, there may be at least one additional raised portion.

Figure 12:
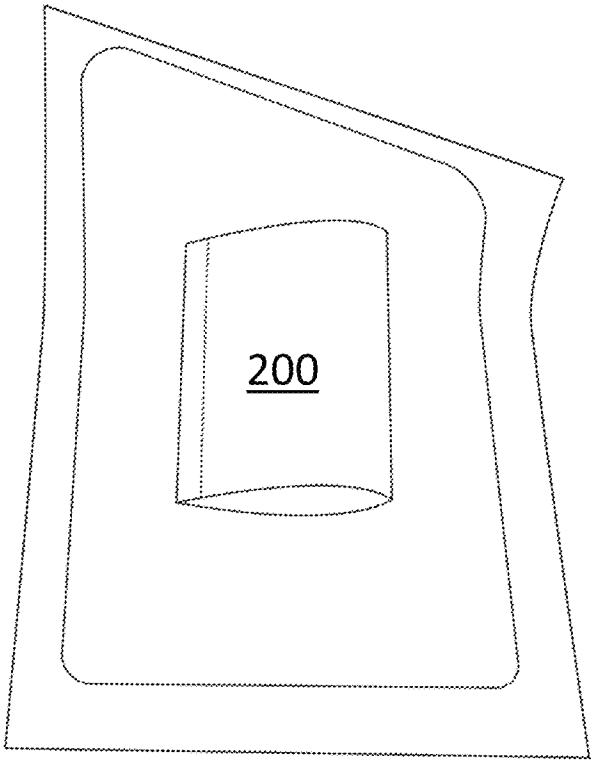
FIG. 12 depicts a back view of the holder depicted in FIG. 11.
Figure 11:
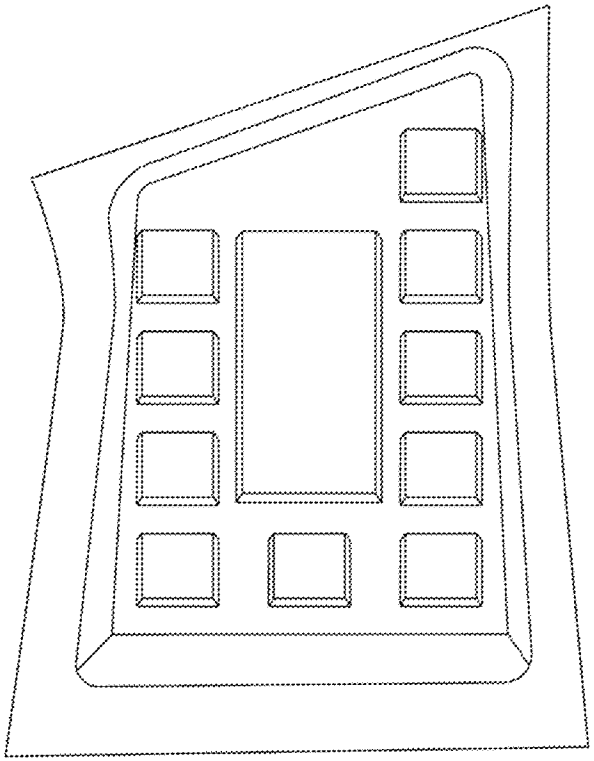
FIG. 11 depicts a front view of a holder with a center raised portion and surrounding raised portions which surround the center raised portion.
Figure 15:
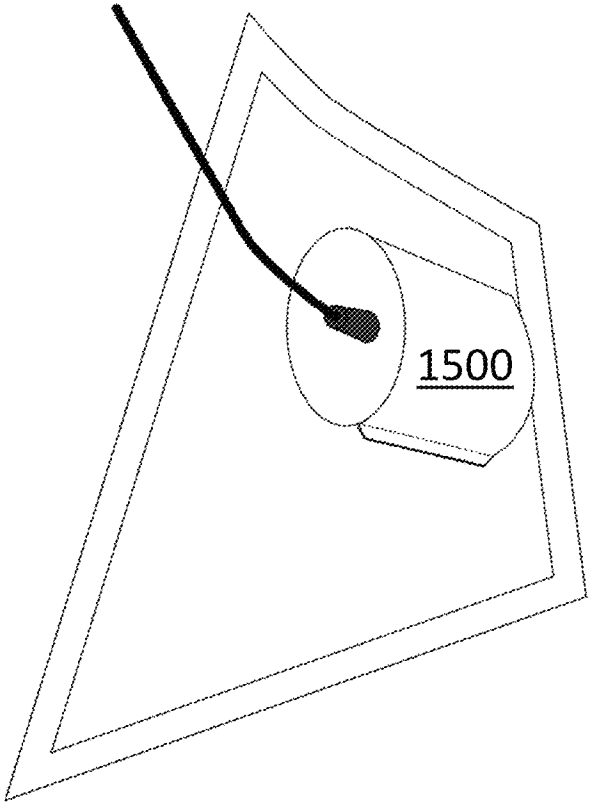
FIG. 15 depicts a cover inside the holder.
Figure 14:
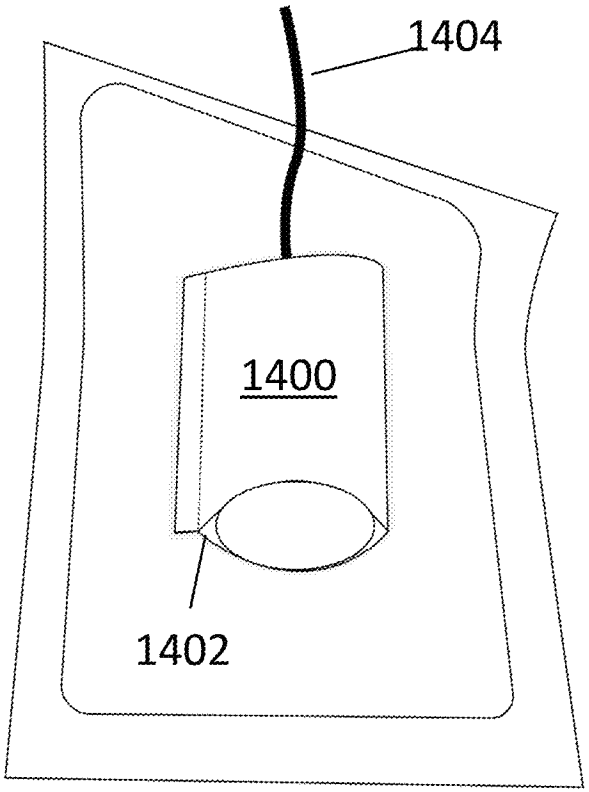
FIG. 14 depicts a cover inside the holder.

As shown in FIG. 12, there may be a massage apparatus cover (1200). See also FIG. 14 massage apparatus cover (1400), FIG. 15 massage apparatus cover (1500), FIG. 27 massage apparatus cover (2700). The cover surrounds the rounding sides of the massage apparatus and at least one of the top end and the bottom end is uncovered. The massage apparatus cover as depicted surrounds the massage apparatus and both the top end and the bottom end are uncovered. The cover may be an elastic material. An elastic material refers to a material with stretch. Stretch fabric is a synthetic fabric that stretches. Stretch fabrics are either 2-way stretch or 4-way stretch. 2-way stretch fabrics stretch in one direction, usually from selvedge to selvedge (but can be in other directions depending on the knit). 4-way stretch fabrics, such as spandex, stretches in both directions, crosswise and lengthwise. Stretch fabrics evolved from the scientific effort to make fibres using neoprene. From this research, in 1958, commercial stretch fabrics ("elastomerics") such as spandex or elastane (widely branded as "Lycra") were brought to the market. The term elastic material as used herein refers to a fabric which may stretch such as spandex, elastane, neoprene, 2-way stretch and 4-way stretch fabrics. As shown in FIGS. 14 and 15, the cover is secured to the indention of the holder, or one side of the massage apparatus is secured to the holder directly. The cover may be secured by an adhesive (1402). The adhesive may be a glue attached to the cover (1400) between the cover (1400) and the indentation.

Figure 13:
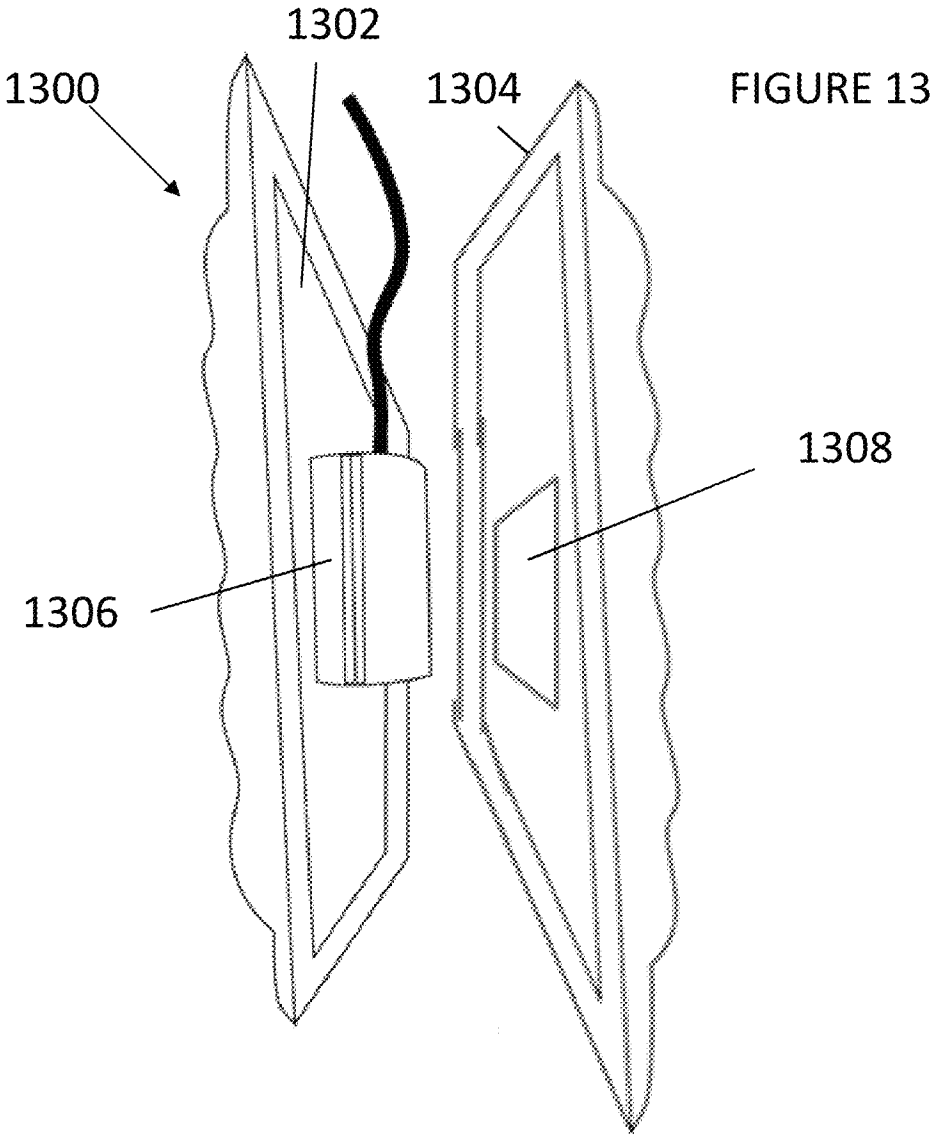
FIG. 13 depicts a side view of an embodiment.

As shown in FIG. 13, there may be a first massage apparatus holder (1300) and a second massage apparatus holder (1304), wherein the first substantially flat portion (1302) of the first massage apparatus holder (1300) is in communication with the second massage apparatus holder (1304) and surrounds a massage apparatus (1306) retained in the indentation (1308) of both the massage apparatus holders.

Figure 35:
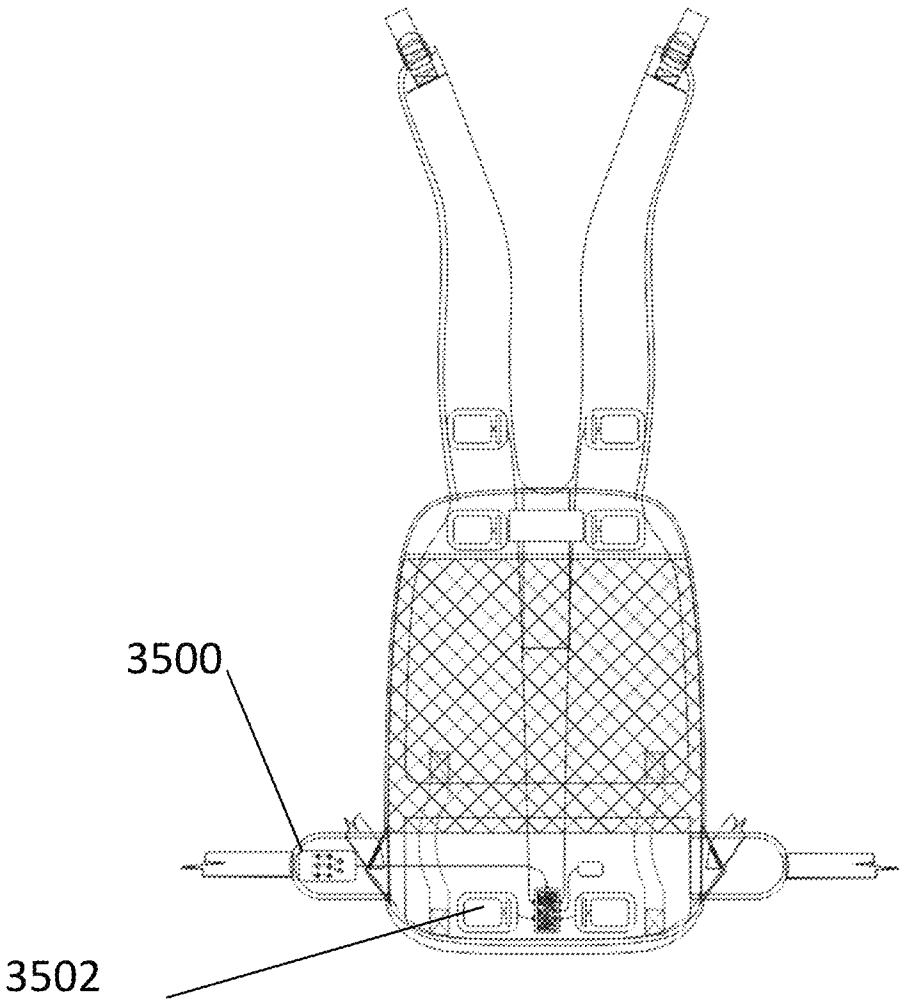
FIG. 35 depicts a control mechanism according to one backpack embodiment.

Alternatively, the first substantially flat portion (1802) is covered by at least one layer of material (1804) which retains, protects and covers the massage apparatus (1806). The material (1804) attached to the holder may be stitched together, glued together or sealed together. The material (1804) may be in communication with a portion of the body. As shown in FIG. 13, the massage apparatus may have a massage mechanism and a control circuit (See FIG. 35, control circuit 3500) used to control the massage mechanism (3502). The control circuit may be further comprised of a power cable (1404) used to supply power to the control circuit and the massage mechanism. The massage apparatus may be substantially rectangular shaped, diamond shaped, triangle shaped, hexagonal shaped and elliptical shaped, with rounding sides and a top end and a bottom end.

Figure 25:
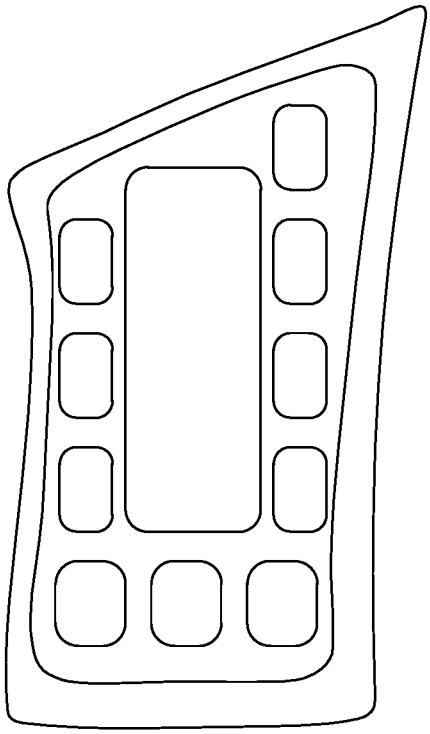
FIGS. 25, 26, 27, 28, 29, 30, 31, 32, 33 and 34 depict one example of the steps to attach a holder to a body.
Figure 26:
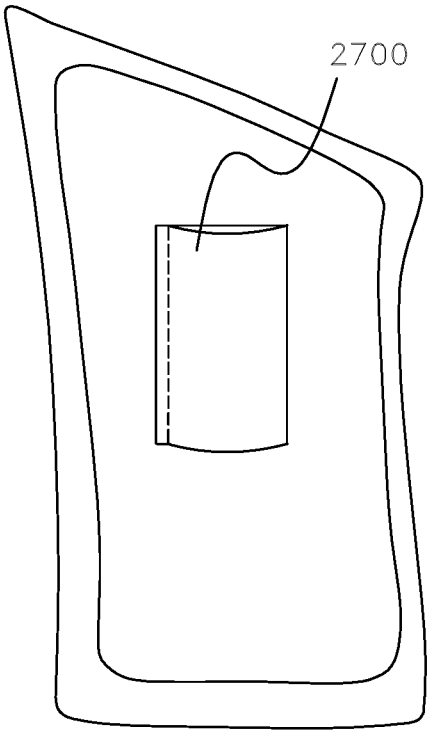
Figure 27:
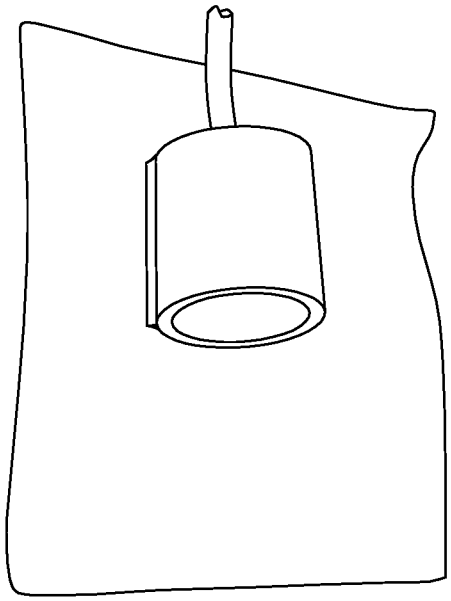
Figure 28:
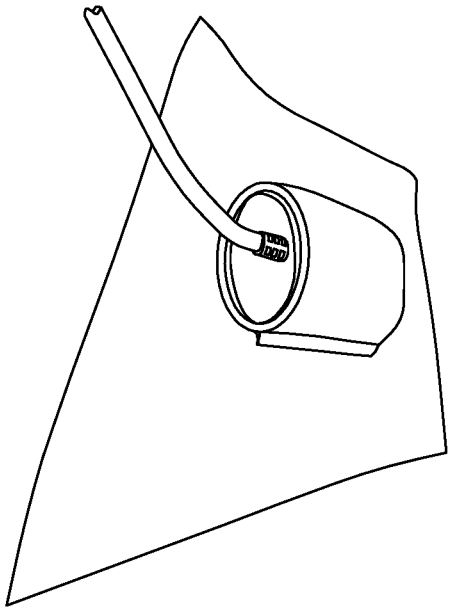
Figure 29:
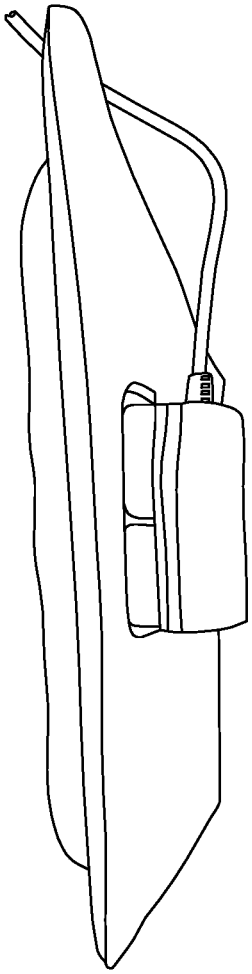
Figure 30:
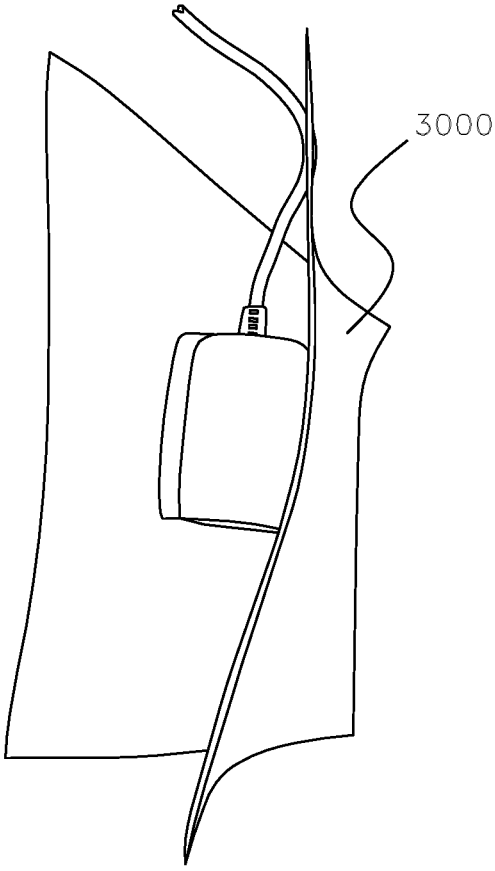
Figure 31:
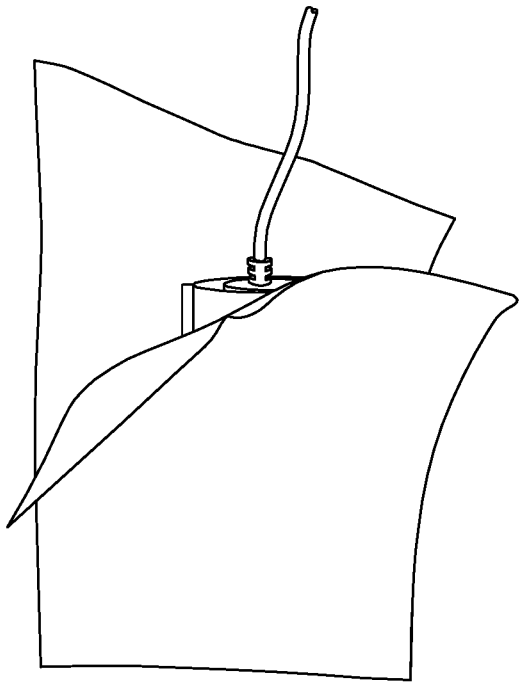
Figure 32:
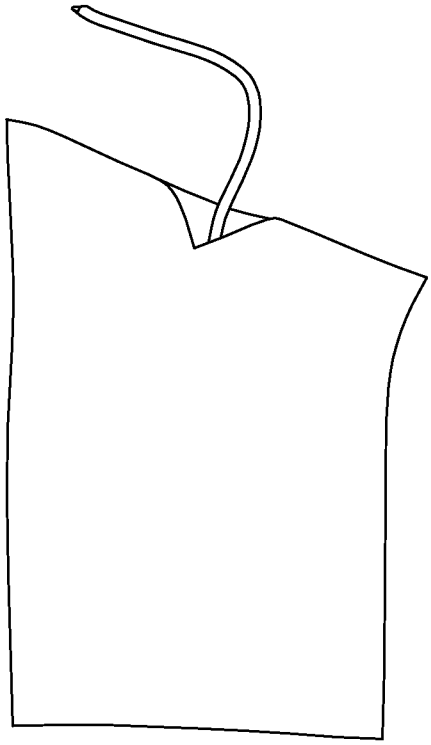
Figure 34:
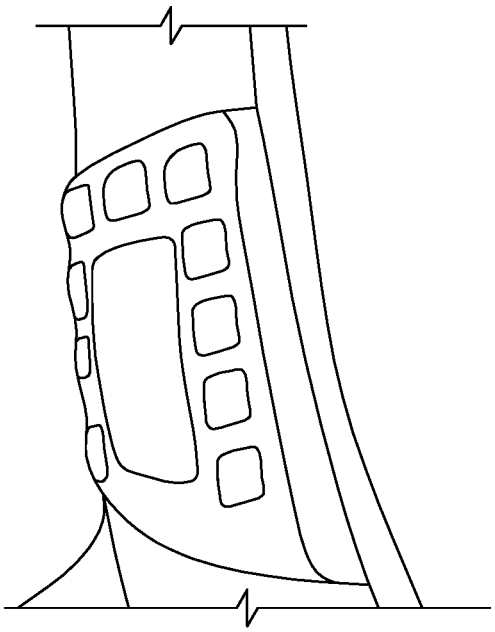
Figure 33:
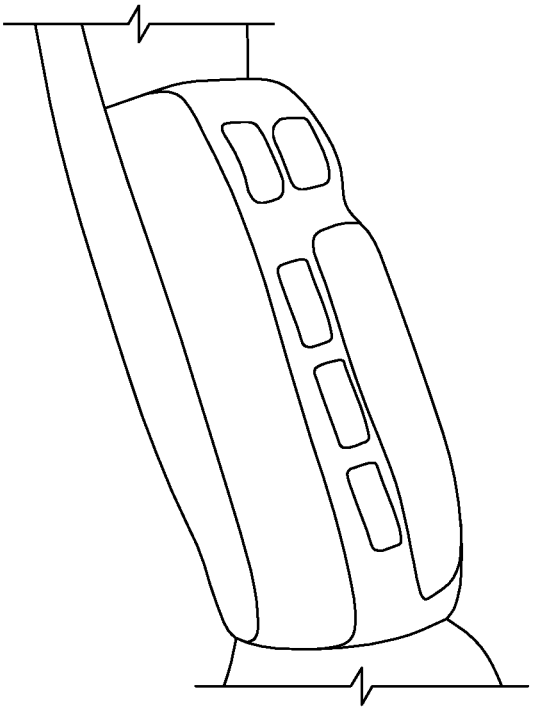

FIGS. 25, 26, 27, 28, 29, 30, 31, 32, 33 and 34 depict an example of how the massage apparatus holder may be attached to a body. FIG. 25 depicts a second holder side, FIG. 26 depicts a first holder side having an indentation shaped with a cover 2700 that is glued to the first holder side. FIGS. 27, 28 and 29 depict that the massager apparatus is put inside the cover. FIGS. 30, 31 and 32 depicts a piece of fabric or at least one layer of material (3000) which retains, protects and covers the massage apparatus and is in communication with the first holder side. This may then be sewn into a shoulder strap, as depicted in FIGS. 33 and 34.

As will be recognized by those skilled in the art, the innovative concepts described in the present application can be modified and varied over a wide range of applications. Accordingly, the scope of patented subject matter should not be limited to any of the specific exemplary teachings discussed above, but is instead defined by the following claims.

What is claimed is:

1. A massage apparatus holder, comprising:

a first holder side having a first substantially flat portion and an indentation shaped to receive a portion of a massage apparatus;

a second holder side having a second substantially flat portion;

wherein the holder is larger in size than the massage apparatus, the thickness of the holder is at least 7 mm and a portion of the holder is attached to a body;

a massage apparatus cover, wherein the massage apparatus cover surrounds the rounding sides of the massage apparatus and at least one of the top end and the bottom end is uncovered.

2. A massage apparatus holder as in claim 1, further comprising:

wherein the body has at least one shoulder strap with a rear side portion and an outside portion, wherein the second holder side of the massage apparatus holder is substantially linear with the rear side portion of the shoulder strap.

3. A massage apparatus holder as in claim 2, wherein the shoulder strap is on one of a backpack, shoulder bag, travel bag, messenger bag, baby carrier and vest.

4. A massage apparatus holder as in claim 1, wherein the second side of the holder has a center raised portion, shaped to correspond the massage apparatus and at least two surrounding raised portions which surround the center raised portion.

5. A massage apparatus holder as in claim 4, wherein the height of the center raised portion and each of the surrounding raised portions are substantially the same level.

6. A massage apparatus holder as in claim 4, wherein the height difference of the center raised portion and each of the surrounding raised portions are between 5 mm and 20 mm.

7. A massage apparatus holder as in claim 4, wherein the shape of the surrounding raised portions are selected from the group consisting of rectangular, circular, square and elliptical.

8. A massage apparatus holder as in claim 4, wherein between the center raised and the at least two surrounding raised portions, there is at least one additional raised portions.

9. A massage apparatus holder as in claim 1, further comprising a massage apparatus having a massage mechanism and a control circuit used to control the massage mechanism.

10. A massage apparatus holder as in claim 9, wherein the control circuit is further comprised of a power cable used to supply power to the control circuit and the massage mechanism.

11. A massage apparatus holder as in claim 1, wherein the massage apparatus is selected from the group consisting of substantially rectangular shaped, diamond shaped, triangle shaped, hexagonal shaped and elliptical shaped, with rounding sides and a top end and a bottom end.

12. A massage apparatus holder as in claim 11, wherein the cover is an elastic material.

13. A massage apparatus holder as in claim 1, wherein either the cover is secured to the indention of the holder, or one side of the massage apparatus is secured to the holder directly.

14. A massage apparatus holder as in claim 1, wherein the cover is secured by an adhesive.

15. A massage holder as in claim 1, wherein there is a first massage apparatus holder and a second massage apparatus holder, wherein the first substantially flat portion of the first massage apparatus holder is in communication with the second massage apparatus holder and surrounds a massage apparatus retained in the indentation of both the massage apparatus holders.

16. A massage apparatus holder as in claim 1, wherein the first substantially flat portion is covered by at least one layer of material which retains, protects and covers the massage apparatus.

17. A massager holder as in claim 16, wherein the material attached to the holder is stitched together, glued together or sealed together.

18. A massage apparatus holder as in claim 16, wherein the material is in communication with a portion of the body.

19. A massage apparatus holder as in claim 1, wherein the holder is made of a foam material selected from the group consisting of Ethylene-vinyl acetate foam, Poly urethane foam, butadiene rubber foam, vinyl acetate foam, Expandable Polyethylene, Polyethylene, Crosslinked polyethylene foaming, Electron radiation crosslinked polyethylene foaming, or any other foamy material.

20. A massage apparatus holder as in claim 1, further comprising a body having a back portion, wherein the second holder side is substantially linear with the back portion.

* * * * *